United States Patent [19]

Coburn et al.

[11] 4,290,558

[45] Sep. 22, 1981

[54] FUEL NOZZLE WITH WATER INJECTION

[75] Inventors: Robert E. Coburn, Mansfield Center; Ronald M. Gabriel, Glastonbury; Richard S. Tuthill, Bolton, all of Conn.

[73] Assignee: United Technologies Corporation, Hartford, Conn.

[21] Appl. No.: 76,638

[22] Filed: Sep. 18, 1979

[51] Int. Cl.[3] ..... B05B 7/10

[52] U.S. Cl. ..... 239/400; 60/39.55; 60/728; 60/748; 239/406

[58] Field of Search ..... 239/400, 403, 405, 406; 60/728, 748, 39.55

[56] References Cited

U.S. PATENT DOCUMENTS

| | | | |
|---|---|---|---|
| 2,965,303 | 12/1960 | Jackson | 60/748 |
| 3,088,280 | 5/1963 | Lefebvre et al. | 60/728 |
| 3,283,502 | 11/1966 | Lefebvre | 60/748 |

*Primary Examiner*—Andres Kashnikow
*Assistant Examiner*—Michael J. Forman
*Attorney, Agent, or Firm*—Norman Friedland

[57] ABSTRACT

An annulus formed in the nut of a fuel nozzle to collect, distribute and atomize water droplets fed into the fuel nozzle for increased thrust produced by a turbine type power plant powering aircraft is discretely formed adjacent the discharge juncture point and discharged angularly into and with respect to the fuel spray emitted into the combustion zone for smoke reduction purposes.

3 Claims, 2 Drawing Figures

FUEL NOZZLE WITH WATER INJECTION

BACKGROUND OF THE INVENTION

This invention relates to fuel nozzle and support assemblies for turbine type power plants and particularly to fuel nozzle and support assemblies having water injection means with smoke reduction characteristics.

One of the criteria necessary for an aircraft engine to meet its specification is the quantity of the smoke emitted in the exhaust. In the interest of cost reduction the two piece nut assembly for the fuel nozzle nut of the JT-9D engine manufactured by Pratt & Whitney Aircraft Group, Division of United Technologies Corporation was made in a single piece. During the development stages a characteristic of that particular assembly was the fact that the single piece nut caused exceedingly high smoke emission when the engine was operated in the water injection mode. This was unsatisfactory from the engine specification requirements. The cause of the problem was not easily defined and while the solution was perhaps simple, once the problem was recognized even this was not fully understood for some time. In the particular fuel nozzle design, the water was injected in an axial direction into the airstream and carried through the nozzle nut by entrainment to emerge in streaks of very large, high velocity droplets intermingling with the fuel spray in the combustion zone. Characteristically, the water emerged from the nozzle in clusters around the 360° periphery of the nozzle outlet which corresponded to the nozzle nut holes which admitted the entrained water.

The solution to this problem was adding an annulus formed in the inner diameter of the nut of the fuel nozzle adjacent the juncture point where the water was injected into the fuel spray in the combustion zone of the combustor. This served to distribute the water uniformly around the 360° circumference of the fuel nozzle discharge point and to break up the large water droplets. From actual tests, this produced a significant reduction in smoke emission making an unacceptable engine from this standpoint acceptable.

SUMMARY OF THE INVENTION

A feature of this invention is to provide for a combustor of a turbine type power plant improved smoke emission means by providing with the fuel nozzle nut, means to uniformly distribute and efficiently atomize the water during the water injection mode of engine operation. The feature is accomplished by providing an annulus in the inner diameter of the fuel nozzle nut adjacent to the fuel and air outlet of the nozzle.

Other features and advantages will be apparent from the specification and claims and from the accompanying drawings which illustrate an embodiment of the invention.

DESCRIPTION OF THE PREFERRED EMBODIMENT

Figure 1:
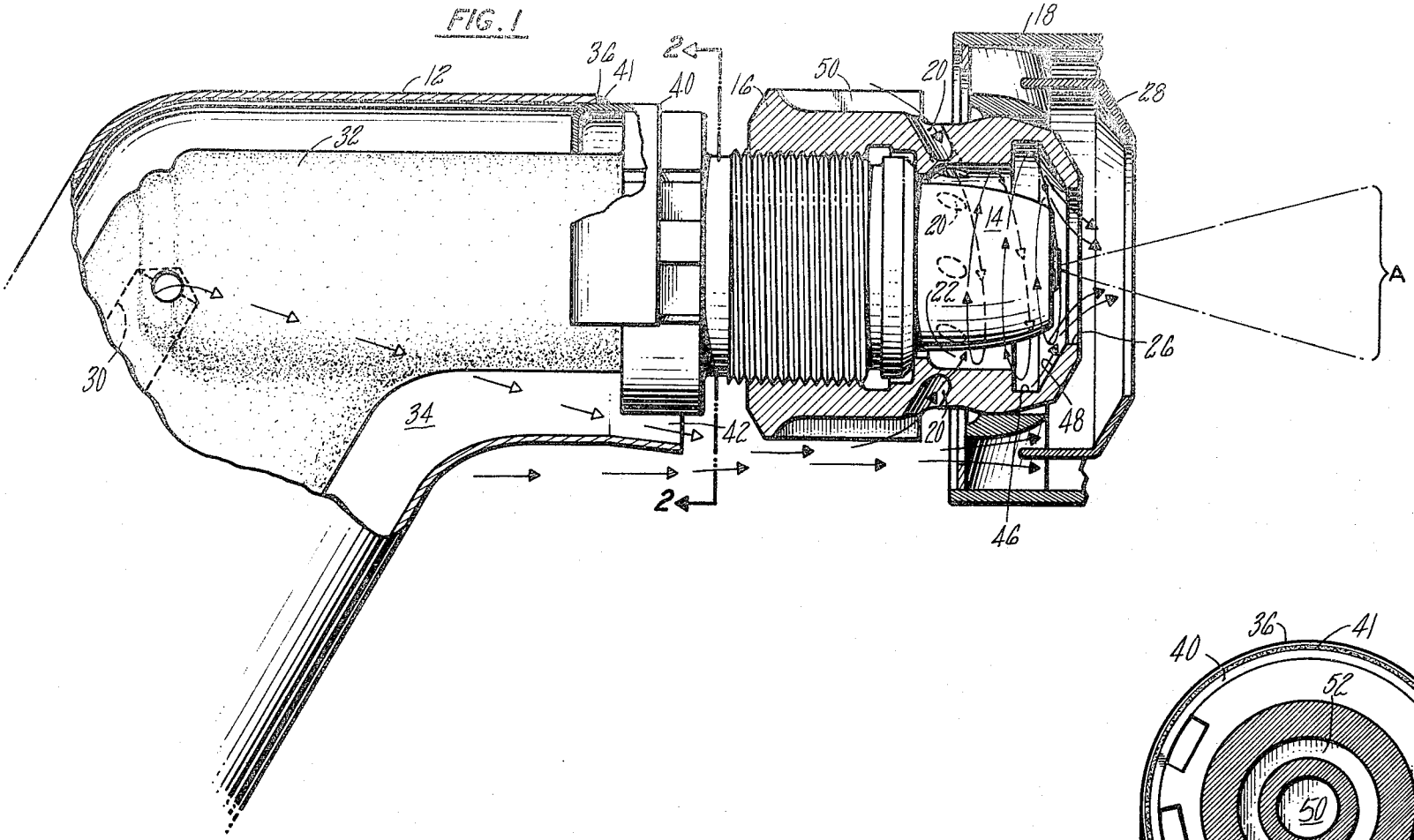
FIG. 1 is a side elevation partial view, partly in section showing the details of this invention.

Inasmuch as this invention constitutes an improvement of the fuel nozzle and support assemblies of the type being utilized in the JT-9D engine manufactured by Pratt & Whitney Aircraft Group, Division of United Technologies Corporation for the sake of simplicity and convenience only that much of the nozzle and support assembly is described that is necessary to enable one skilled in the art to practice this invention. Suffice it to say that the fuel nozzle is of the pressure atomizer swirl type that includes a primary nozzle orifice and secondary nozzle orifices that inject fuel into a conical spray illustrated by reference letter A.

As is well known, the nozzle and support assembly is mounted at the front end of the burner and is located in the downstream portion of the diffuser section which serves to diffuse the air discharging from the compressor. The air passes over the heatshield 12 of the nozzle support 32 suitably supporting the fuel nozzle generally illustrated by reference numeral 14 and passes over the fuel nozzle nut 16 where a portion passes through the swirl vanes 18 and a portion passes through the passages 20, eight of which are formed around the periphery of the nozzle nut. As noted, these passages are skewed at an angle to pick up the compressed air and swirl it on the nut inner diameter. This air fed into the annular space 22 flows over the end of nozzle 14 and discharges into the combustion zone through the central opening 26 formed on the end of nozzle nut 16.

The air in the swirler 18 is divided by splitter 28 directing a portion of the air toward the fuel spray cone A for proper combustion.

During water injection mode of operation water is fed through a suitable passage 30 formed in the support body 32 and discharged into the annular space 34 formed between the support body 32 and the heat shield 12. The cylindrical heat shield 12 has its end 36 butting against the dam like element 40 which is welded thereto by weldment 41 and contains a window 42 for discharging the water into the mainstream. As the water passes over nut 16 a portion thereof is forced through passages 20. Because of the angle of these passages, the air and water are caused to rotate in annular space 22 around the inner diameter of fuel nozzle nut 16. In accordance with this invention, the inner diameter of nut 16 carries an annular recess 46 formed adjacent the central opening 26 of nut 16 and serves to collect and distribute the water discharging from passage 20.

As is apparent from the foregoing, the centrifuging effect of the swirling air tends to force the water droplets into recess 46 and distribute the water around the 360° circumference. The airflow then carries the water in a rearward direction along the face 48 formed on the inner diameter of nut 16 where it is discharged in a spray of small droplets to intermingle with the fuel spray cone A.

Actual tests have shown that without the recess 46 the emission smoke is significantly increased when the engine runs in the water injection mode. Hence, the inclusion of recess 46 has significantly reduced smoke emission when the engine operates in this mode.

The nut carries eight lugs 50 which serve to accommodate a tool for torquing the nut threaded to the nozzle support 32.

Figure 2:
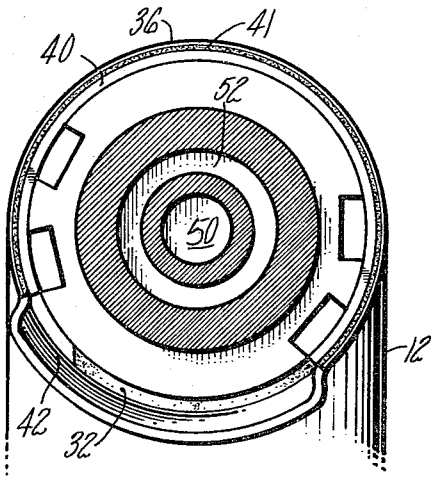
FIG. 2 is a view in section taken along lines 2—2 of FIG. 1.

As noted in FIG. 2, the nozzle 14 has formed therein primary fuel passage 50 and secondary fuel passage 52. Dam element 40 partially surrounds the circumferential space between the heat shield 12 and support body 32.

It should be understood that the invention is not limited to the particular embodiments shown and described herein, but that various changes and modifications may be made without departing from the spirit and scope of this novel concept as defined by the following claims.

We claim:

1. Apparatus for reducing smoke emissions exhausting from a gas turbine engine during water injection mode of operation, including a nozzle support having a generally cylindrically shaped body, a nozzle supported at one end thereof, an aperture in one end of said nozzle for injecting fuel centrally of said nozzle in a conical array, said conical array having an apex, a nozzle nut threadably supported on one end of said nozzle support, said nozzle nut having a generally conically shaped end portion surrounding a central opening concentric to said nozzle from which said apex of said conical array of fuel is formed, means for leading water through a plurality of drilled passages spaced about the circumference of said nozzle nut into a generally annularly shaped passageway formed between the inner diameter of said nozzle nut and the outer diameter of said nozzle and communicating with said central opening, an annular recess having a radially outwardly extending bore at one end of said annularly shaped passageway remote from said passages formed in the inner diameter of said nozzle nut for collecting water admitted into said annularly shaped passageway and also having a conically shaped wall radiating from a larger diameter at the extreme radial position of said bore to a smaller diameter adjacent said central opening, whereby the water collected in said recess is discharged about the entire circumference of said opening in a spray of small droplet size.

2. Apparatus as claimed in claim 1 including a heat shield concentric to and spaced from said nozzle support and encasing a portion of said nozzle support, a ring element surrounding said nozzle support adjacent the end of said heat shield member and being joined thereto for enclosing the space formed between said heat shield and said nozzle support, and a window formed at the end of said heat shield for discharging water lead thereto by a passage formed in said nozzle support.

3. Apparatus as claimed in claim 1 whereby said drilled passages are angularly formed in said nozzle nut relative to the center line thereof for imparting a rotational movement to said water.

* * * * *